United States Patent [19]

Mohla

[11] 4,204,666

[45] May 27, 1980

[54] IN SITU FURNACE METAL DESULFURIZATION/NODULARIZATION BY HIGH PURITY MAGNESIUM

[75] Inventor: Prem P. Mohla, Canton, Mich.

[73] Assignee: Ford Motor Company, Dearborn, Mich.

[21] Appl. No.: 943,274

[22] Filed: Sep. 18, 1978

Related U.S. Application Data

[62] Division of Ser. No. 856,697, Dec. 2, 1977.

[51] Int. Cl.[2] ..... C21C 1/02; C22C 33/10; C21C 7/02; D02G 3/00

[52] U.S. Cl. ..... 266/216; 75/130 B; 75/130 R; 266/160; 75/53; 75/93 G; 428/222; 428/371; 428/377

[58] Field of Search ..... 75/130 A, 130 B, 130 C, 75/130 R, 93, 53 G; 428/222, 364, 371, 377, 471; 266/160, 216

[56] References Cited

U.S. PATENT DOCUMENTS

| | | | |
|---|---|---|---|
| 2,776,206 | 1/1957 | Klingbeil | 75/130 B |
| 2,872,179 | 2/1959 | Fisher | 75/130 B |
| 3,598,575 | 8/1971 | Jarysta | 75/130 A |
| 3,801,303 | 4/1974 | Kotler et al. | 75/130 A |
| 3,854,939 | 12/1974 | Mezoff | 75/130 B |
| 3,953,198 | 4/1976 | Easwaran et al. | 75/130 A |

*Primary Examiner*—William R. Dixon, Jr.
*Attorney, Agent, or Firm*—Joseph W. Malleck; Keith L. Zerschling

[57] ABSTRACT

A method of desulfurizing iron in an induction furnace is disclosed. High purity magnesium, carried in a lance controlled cartridge, is plunged into the lower zone of a molten metal pool of an induction furnace; the cartridge is held submerged for a period of 30–200 seconds. The molten metal column above the submerged cartridge must be at least 2.5 feet, preferably 6–7 feet. The molten metal temperature at the time of cartridge plunging is limited to 2400° F. or less. Magnesium recovery will be at least 70%, which is better than other prior art methods by a factor of 1.4.

1 Claim, 4 Drawing Figures

IN SITU FURNACE METAL DESULFURIZATION/NODULARIZATION BY HIGH PURITY MAGNESIUM

This is a division of application Ser. No. 856,697 filed Dec. 2, 1977.

BACKGROUND OF THE INVENTION

High sulfur iron has been treated external to a melt unit, typically in the ladle or launder, by employing suitable agents consisting of sodium carbonate, calcium carbonate,burnt lime, calcium cyanamide, calcium carbide and rare-earths. Of all these materials, the desulfurizing potential of calcium carbide, using the porous plug and/or injection of calcium carbide with nitrogen gas, is universally well recognized. The reaction kinetics of sulfur removal from the metal largely depend upon how intimately the metal and the desulfurizing agent is mixed and this is achieved in actual practice by blowing nitrogen gas through a porous refractory at the bottom of the ladle. Calcium sulfide and unreacted calcium carbide and oxides that are formed go into the slag which is removed from the metal. Due to the potential hazards of forming acetylene gas when contacted with moisture, the calcium carbide and the resultant slag requires very careful handling.

Little recognition has been given to the desulfurizing effects of magnesium and calcium metals. Magnesium has been principally appreciated as a nodularizing agent for iron and has required the use of a relatively low sulfur iron. Laboratory investigations have shown that where the sulfur is more than 0.01%, which is the maximum desired for nodularization, the magnesium will first desulfurize and then nodularize. In spite of the fact that magnesium can achieve desulfurization and nodularization simultaneously, it is accepted that it is most difficult to retain magnesium in the molten iron so that it can desulfurize. This difficulty arises from a variety of physical characteristics which include: (a) the typical treatment temperature for molten iron is usually at about 2600–2800° F. and magnesium is in vapor form at that temperature level; (b) the solubility of magnesium into molten iron is extremely low; (c) magnesium oxidizes extremely rapidly when it comes into contact with air; (d) magnesium is a very light material and due to its low density tends to float on the molten metal and become oxidized; and (e) magnesium is extremely reactive with molten iron and produces considerable pyrotechnic display which may consist of bursts of iron particles due to such reactivity.

The prior art has attempted to carry out the magnesium reaction according to principally four methods: the sandwich method, the injection method, the plunging process, and the Fisher or Kuboto processes requiring a pressure tight reaction chamber. The sandwich method involves diluting the magnesium with nickel or silicon, etc., such as in an alloy form, so that when the diluted material is brought into contact with the molten iron, which is preferably laid on the bottom of the molten vessel. A reduced magnesium vapor pressure will result and thus retard the tendency to send off magnesium vapors with extreme reactivity. Examples of magnesium alloys include Mg-Ni and Mg-Fe-Si. Unfortunately the latter alloy is insufficiently heavy, as compared to the Ni-Mg alloy, so that additional steel cover of particles is necessary to prevent it from floating in the reaction ladle. The difficulty with the sandwich method is that the recovery of magnesium is only about 30–50% of the magnesium that is added to the process. Recovery shall mean herein the ratio between the units of a material added to a process and the units of the material appearing in the final metal product plus that combined with impurities.

Although not commercially used, the injection of magnesium powder takes place by use of an inert vehicle, such as nitrogen gas. It is typical for such magnesium powder to carry an oxide coating thereon by the mere nature of the production of the magnesium particles. Therefore, the recovery of pure magnesium in the final metal as compared to that which is utilized at the starting point, is extremely low (30% recoveries are typical).

The plunging process uses a block of pure magnesium coated with layers of a suitable refractory; or a coke body impregnated with pure or high magnesium, each of which are plunged into the molten bath of iron. If carried out in a conventional way with the plunging tool introduced from the top of an open ladle and carried close to the bottom of the vessel, the recovery of magnesium again is typically about 30–50%.

The Kuboto process includes the introduction of pure magnesium to a body of molten iron in a sealed pressure vessel. The vessel must withstand pressures of at least 15 atmospheres, the vapor pressure that will be immediately produced by the magnesium iron reaction. The iron is supersaturated with magnesium and then diluted with the unreacted molten metal to achieve the desired magnesium content. The Fisher process again includes introduction of pure magnesium to a body of molten iron through a reaction chamber to a loosely closed vessel. Magnesium is retained under the molten iron in a small pocket containing holes through which the reaction proceeds until completed. Unfortunately, the recovery of the magnesium by either Kuboto or Fisher is still relatively low, at around the 40% level.

SUMMARY OF THE INVENTION

A primary object of this invention is to provide an improved method for treating molten iron wherein the magnesium recovery is substantially increased, thereby considerably improving operating costs.

Another object of this invention is to provide a method which permits desulfurization and/or nodularization of molten iron in a coreless induction melting furnace.

Yet still another object of this invention is to provide a combined process for producing an iron casting which is both desulfurized and nodularized, the desulfurization being carried out in the furnace.

Yet still another object of this invention is to provide a method for making plunging cartridges for the introduction of pure magnesium in molten iron. The magnesium containing cartridges are more economical and easier to produce to bring about a more controlled magnesium dissolution into the molten metal.

Features pursuant to the above objects comprise: (a) the use of a molten metal column of at least 2.5 feet in height which column critically controls and suppresses the high vapor pressure of the magnesium so that bubbles of the magnesium reaction are unable to disrupt the desired coherent body of molten metal which is generally quiescent; (b) control of the molten metal temperature to be as low as possible without significant superheat (2300–2400° F.), during which time magnesium is added to provide a magensium vapor pressure considerably less than that which is normally experienced when the metal temperature is uncontrolled and at a higher level; (c) introducing magnesium in a quantity to desulfurize only that much of the metal which is emptied at each discharge; this is typically only about one-third of the metal within the furnace thereby providing for increased recovery of magnesium when chemically operating upon a reduced volume of untreated metal; (d) removing the sulfur containing slag after the magnesium reaction has taken place (to prevent sulfur reversion) and slightly superheating the metal to the required tapping temperature; and (e) arranging the treatable metal to have a high sulfur content to increase the desulfurizing efficiency at low treatment temperature.

DETAILED DESCRIPTION

Figure 1:
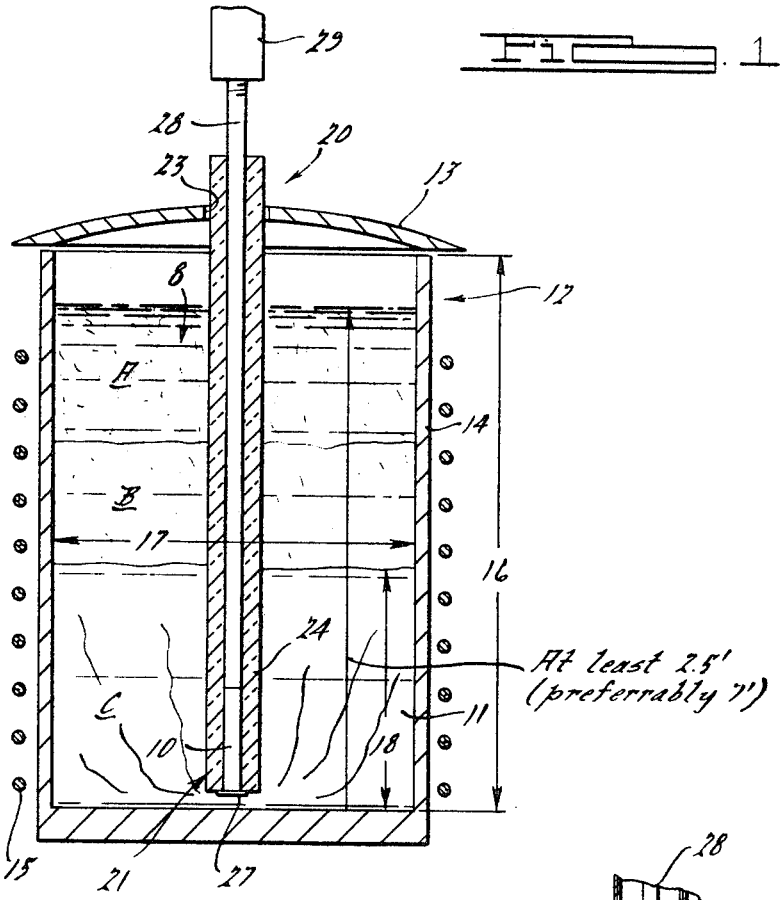
FIG. 1 is a central sectional elevational view of a coreless induction melting furnace containing molten metal undergoing desulfurization in accordance with this invention.

This invention requires that pure magnesium 10 be introduced into a molten charge of iron 11 within a melting/holding furnace 12. The melting furnace can be of several different types, preferably a coreless induction type melting furnace having access, as through cover 13, to introduce a desulfurizing agent. A cupola would have no access and an arc furnace would not provide sufficient column height for the molten metal.

A typical coreless induction furnace for carrying out the invention may comprise a refractory vessel 14 carrying one or more water cooled induction coils 15 around the exterior. The vessel is deep (16) compared to its inside diameter (17). The coreless induction furnace will provide a molten metal head of at least 2.5 feet with a 2000 pound charge. Typically a 20 ton furnace will provide a metal height or column of about 7–8 feet. Initially low sulfur (0.01%) scrap iron is charged into the furnace and melted down; on a subsequent continuing basis (working on the flywheel principle), only about one-third additional solid scrap iron (which may vary in sulfur content between 0.01–0.1%) is added to the furnace when about a third of the molten metal (with the desired chemistry and temperature) is withdrawn from the furnace. When a new charge of scrap iron is added, there will exist temporarily three zones, zone A of solid charge, zone B of semi-melted material, and zone C of molten desulfurized iron from the previous cycle. However, the three zones become one homogeneous mass after sufficient melting time and before any metal treatment is again used. Once the common pool is formed, it is homogenized by the strong stirring action of the induction heating coils. Thus, the average sulfur content will drop and the requirement for a sulfur treating agent is reduced to that which is necessary to treat one-third of the pool.

As a result of the addition of the solid charge material into molten metal, the temperature of the furnace metal will be considerably reduced, typically to around 2200° F. The electrical power to the furnace is switched on until all the solid charge pieces have melted. The power is turned off, the metal temperature is checked, and pure or high magnesium is carried to the lower section of the pool such as by way of a lance 20.

Preweighed magnesium 10, in pure form or a high content of magnesium alloy is contained in a suitably designed cartridge 21 or a plunging bell (comprised of clay-graphite); the cartridge is carried through the central hole 23 in the furnace over deep into the bottom portion of the liquid metal pool 8. The cartridge may consist of pure magnesium or high magnesium alloy enclosed by a refractory tube 24 (shown in FIG. 1) or a steel tube 25 with a refractory coating 26 (shown in FIG. 2). A steel plate 27 is provided to protect the magnesium from molten iron when the cartridge is being carried into position within the molten metal. Once the magnesium cartridge is fully immersed under the metal, the steel plate 27 melts and permits the magnesium to react with the molten metal. The lance 20 may consist of a cast iron pipe 28 carrying said refractory cylinder 24; the pipe 28 may be operably raised and lowered by a pneumatic apparatus 29.

Figure 2:
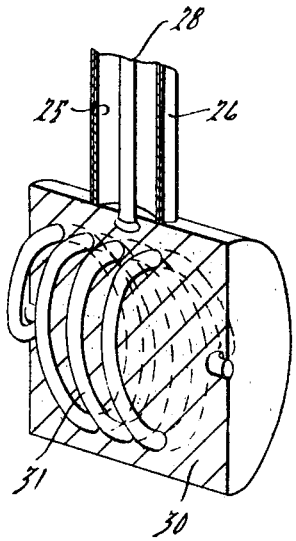
FIG. 2 is an enlarged fragmentary perspective view of a preferred metal treating cartridge.

FIG. 2 further illustrates another mode for constructing the cartridge; it comprises a sodium silicate sand body 30 within which is cast a screw or helical shaped ribbon 31 of pure magnesium. The ribbon is exposed at opposite ends of the body 30. The configuration adds further control to the time reaction with the molten iron, a non-straight (or tortuous, path of communication between the molten iron and the next available magnesium, slows down the molten iron-Mg interaction.

In some applications, the magnesium vapor evolution and buoyancy of the plunged cartridge tends to tilt or skew the lance within the furnace, and may cause unwanted contact between the cartridge and furnace lining. To overcome this problem, a porous refractory baffle may be mounted on the lance in such a position that it will extend horizontally across substantially the entire cross section of the furnace at a depth of 6–18" below the molten metal surface. The baffle will act as stabilizing plate orienting the lance to a vertical upright position in opposition to the skewing forces. The baffle may be constructed of bonded silica sand, graphite or other refractory. The baffle insert must have sufficient porosity to allow turbulating metal to rise therethrough and form a slag layer at the top surface of the molten metal column. The baffle wil thus act as a means to quiet the turbulation. Furthermore, the baffle will facilitate slag removal by providing a simple structure which when raised above the molten metal surface, will lift and instantly skim the metal surface of coagulated slag elements, the latter being larger than the size of the openings which are formed to constitute said porosity.

The cartridge is held in the immersed zone for a period of 30–200 seconds to permit the magnesium to be heated by and react with the molten metal under controlled conditions. During the period, magnesium will vaporize and may form bubbles deep within the body of molten iron. The magnesium will be transformed into the vapor form with high vapor pressure proportional to the metal temperature. This vapor pressure will be counteracted by the height of the molten metal column and by external pressure. It is important that the induction furnace control the temperature of the molten metal in the lowermost zone to about 2300°–2400° F. or lower. In this temperature condition, the vapor pressure of magnesium will be held to a minimum as compared to the vapor pressure created when added to molten iron in a ladle held at 2600° F. or greater. When magnesium is plunged into iron in the furnace at a metal temperature greater than 2400° F., the magnesium vapor formation rate must be controllably delayed more closely to achieve longer reaction times. Furthermore, the concentration of the magnesium, although preferably pure, but can be diluted to control boiling of the metal if the latter is experienced.

The vapor generated by heating of magnesium under the above conditions will encounter the full height of the metal in the furnace even though the quantity of plunged magnesium is calculated to react with only one-third or less of the metal charge which contains higher sulfur (typically about 0.05%, but as high as 0.10%) than that in the retained molten metal previously desulfurized. This will provide greater dwell or contact time for the magnesium bubbles with the molten iron and greatly improves the magnesium recovery. The magnesium sulphide that is formed will float to the top of the molten iron and form a slag with other slag forming constituents of the solid charge; the slag is removed by skimming. Magnesium sulphide will react with $O_2$ and form MgO if permitted, the freed sulfur returning to the molten metal. This reversion is prevented by spreading coke breeze on the surface of the molten pool.

The furnace and metal now desulfurized is slightly superheated to the desired tapping temperature and the above cycle is repeated, including withdrawing molten metal, charging solid material, and plunging magnesium.

The charge to the furnace will contain an amount of scrap iron equivalent to that of the molten iron that has been withdrawn; it should contain a sulfur content in the range of 0.02–20% (preferably about 0.15%). The molten iron which is tapped from the furnace will contain a sulfur content in the range of 0.02–0.008% and a magnesium content of 0.02–0.09%. If excess magnesium is inadvertently used as a treating agent during plunging in the furnace, and the excess is retained in the molten iron, it will soon oxidize to magnesium oxide during metal superheating and thus be removed causing no adverse effects during subsequent nodularizing treatments in the ladel or in the mold. Alternatively, excess magnesium, enough to desulfurize and nodularize, can be employed in the cartridge to carry out the two processes within the furnace thus giving nodular iron directly from the furnace. In this case the metal treatment should be higher than 2200°–2300° F., thus requiring very little or no superheating after the magnesium addition. In the event the furnace is emptied to more than one-third capacity, the magnesium addition to the metal will correspond to the equivalent of the metal to be desulfurized and/or nodularized.

The second important step to obtain nodular iron is to convey the desulfurized molten iron to a mold containing an intermediate chamber within which is placed an additional magnesium agent, preferably in an alloyed condition. The molten iron entering the reaction chamber of the mold will be essentially free of dissolved magnesium since magnesium is very time sensitive and fades after periods longer than 10–15 minutes. Typically the magnesium alloy consists of 5–10% magnesium; it is added to the reaction chamber in a particulate or solid cast or compacted block form. The solid cast block form is preferable because of better solution control as the molten metal is passed thereacross. The temperature at which the molten metal is introduced to the reaction chamber is typically in the temperature range of 2450–2650° F., which is lower than that employed as a commercial practice by the prior art if the metal is treated in the ladle.

The controlled release of magnesium vapors, when magnesium is submerged under the molten iron, is important in achieving high magnesium recoveries. It is the escape of magnesium vapors that reduces magnesium recovery. Recovery includes the magnesium dissolved the final metal produce plus that combined with sulfur. The magnesium recoveries possible with this invention range from 70–98%.

In addition to the treatment temperature, the design of the cartridge containing pure magnesium or an alloy of magnesium is important. The magnesium needs to be protected from the molten so that the reaction rate is slow. According to this invention, a method or producing a cartridge comprises making a cartridge body of sodium silicate bonded sand to contain a vaporizable core which is to be displaced by magnesium. The core is preferably formed of polystyrene or styrofoam. Pure molten magnesium is poured into the sodium silicate body evaporating the styrofoam and leaving a residue of pure magnesium. It is preferable that the magnesium ribbon have a helical or screw thread configuration. Thus as each increment of the ribbon is reacted, the molten metal must move in a non-straight path to reach the next increment of the ribbon.

This mold or cartridge can then be attached to the end of a graphite or a refractory lance to conduct plunging. One example of a cast magnesium cartridge employed the helical ribbon, is shown in FIG. 1. Another form of the cartridge is shown in the submerged condition in FIG. 2; this latter cartridge is made with magnesium chips and borings or wrought magnesium bassete enclosed in a refractory material.

SPECIFIC EXAMPLES

A metal charge of 46,000 pounds was prepared utilizing scrap iron typically having a chemistry analysis of 0.08% carbon by weight; 0.03% sulfur, and the remainder essentially iron. The sulfur content was the average of that in the new molten metal in zone C and that in any desulfurized molten metal left over from a previous plunged step. The metal scrap was added to an electrical induction furnace having an internal diameter of about four feet. The lining of the furnace consists of silica. A molten pool of iron was generated having a column height of 8 feet. The molten metal was controlled to a temperature of 2300° F. at which time 11.5 pounds of magnesium was plunged thereinto. Additional scrap was sequentially added to the furnace every time a predetermined quantity of molten iron was withdrawn from the bottom portion of the furnace. The amount withdrawn was dependent upon the cleanliness of the scrap and desired sulfur levels in the metal. In this case the attained sulfur was 0.005% and the magnesium recovery was 80%.

In another test, 46,000 pounds of iron were charged into an induction furnace; the average sulphur content of the new and previously desulfurized molten iron was 0.03%. 13.5 pounds of magnesium was plunged into zone C with metal held at a temperature of 2400° F. The molten metal column height was 8 feet. The resulting sulphur content of the treated metal was 0.005% and the magnesium recovery was 67.5%.

When the average sulfur content of the molten metal was regulated to 0.06–0.15%, and the molten iron column regulated to 10 feet at a temperature of 2240° F., final sulfur values of 0.01% with 95% magnesium recoveries could be achieved.

Figure 3:
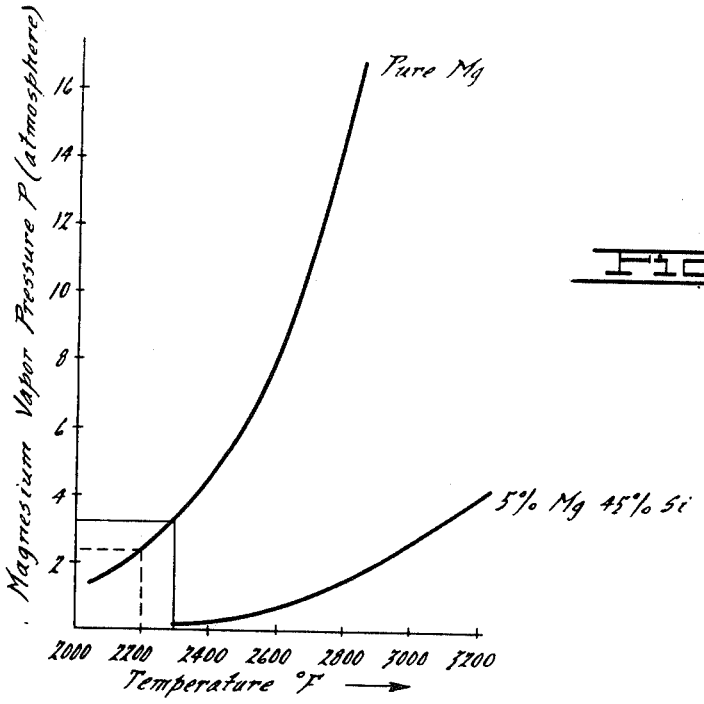
FIG. 3 is a graphical illustration plotting magnesium vapor pressure against temperature for two different treating agent contents.
Figure 4:
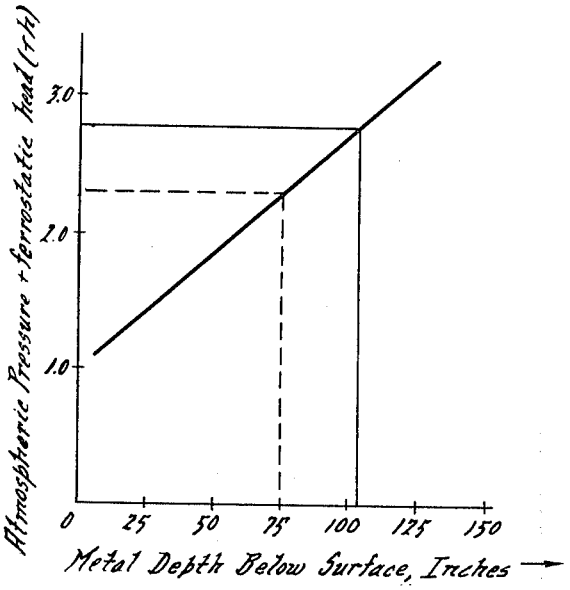
FIG. 4 is a graphical illustration plotting atmospheric pressure and ferrostatic pressure head against the metal depth below the surface in the furnace, for pure magnesium.

From tests as these, certain relationships have been documented. FIG. 2 shows the relationship between the magnesium vapor pressure ($P_{Mg}$) and treatment temperature (T). It shows that the vapor pressure increased rapidly with an increase in temperature beyond 2400° F. For example at 2400° F. metal temperature, the magnesium vapor pressure is approximately 4.5 atmospheres, however at 2700° F. the corresponding pressure is approximately 11 atmospheres. The magnesium vapor pressure can be significantly reduced by diluting Mg and using it as an alloy of 5% Mg 45% Si alloy (FIG. 3). Alternately, by increasing the external pressure, the magnesium can be made to dissolve in the iron without boiling, but this can also be achieved by increasing the ferrostatic metal head ($\gamma h$) at a constant external pressure. FIG. 4 shows the relationship of ($\gamma h$) at atmospheric pressure without the magnesium boil. FIGS. 3 and 4 can be used to select the conditions under which magnesium will dissolve in iron without appreciable boiling. At 2200° F., for example, magnesium has a vapor pressure of a little over 2 atmospheres (denoted by the broken line in FIG. 3). If this value is plotted on the vertical axis in FIG. 4, the value of 75 inches is obtained on the horizontal axis, denoted by the broken line in FIG. 4. Thus, to ensure that solution takes place without boiling or any significant losses at 2200° F. and at atmospheric pressure, the additive must be immersed in the metal to a depth of 75 inches. If the magnesium treatment is carried out at 2700° F., the magnesium vapor pressure generated will be equivalent to 11 atmospheres which pressure will almost be impossible to suppress without the use of an autoclave (which must be kept under high pressure).

In a more practical case, use if made of a coreless induction furnace having a 23 ton capacity and having a metal depth of approximately 108 inches (once it is full of molten iron). After the desired metal temperature and chemistry is reached, about 7 tons of metal is withdrawn in a single step (or in 2–3 steps) from the furnace and an equivalent amount of solid charge is added to the furnace to replace that withdrawn. The furnace metal temperature drops to below 2200° F. After putting on the electrical power until the solid pieces have melted without superheating the metal, the known quantity of pure magnesium or magnesium alloy (which is determined by the amount of sulfur to be removed from the metal and is contained in a cartridge) is immersed into the metal at a selected temperature, preferably about 2300° F. The magnesium vapor pressure will be released gradually building to a maximum of 3.2 atmospheres. However, since the magnesium is plunged to a maximum depth of 108 inches (equal to the depth of the metal in the furnace), the metal columns counteract the vapor pressure to an equivalent value of 2.80 atmospheres. The resultant effect will be that magnesium vapors will migrate through the metal with only 0.4 atmospheres (the latter is far less than if the magnesium treatment were to be carried out for the 7 tons of metal in a ladle close to the pouring temperatures, 2600° F.). In actual practice, depending upon the rate of release of the Mg vapor, boiling of metal may not take place and the reaction may proceed quietly or with very little metal splashing.

I claim:

1. A metal treating element, comprising:

(a) a sodium silicate body;

(b) a non-destructible lance connected to said body for plunging same into a molten pool;

(c) a helical screw shaped insert of magnesium, cast within said body.

* * * * *